United States Patent [19]

Steigerwald et al.

[11] 4,271,045

[45] Jun. 2, 1981

[54] ELECTRICALLY CONDUCTIVE LAYER AND METHOD FOR ITS PRODUCTION

[76] Inventors: Wolf-Erhard Steigerwald, Goethestrasse 1, 8740 Bad Neustadt, Saale; Peter Ambros, Jahnstrasse 6, 8741 Hohenroth; Hermann Geyer, Eckart-Roder-Str. 13, 8789 Oberbach, all of Fed. Rep. of Germany

[21] Appl. No.: 904,307

[22] Filed: Jun. 13, 1978

[51] Int. Cl.[3] ..... H01B 1/06

[52] U.S. Cl. ..... 252/511; 252/503; 252/504; 252/506; 252/507; 252/508; 427/113; 427/122; 427/217; 427/227; 428/537

[58] Field of Search ..... 252/503, 504, 506–508, 252/511; 427/217, 113, 122, 227; 428/537

[56] References Cited

U.S. PATENT DOCUMENTS

| | | | |
|---|---|---|---|
| 3,576,387 | 4/1971 | Derby | 252/511 X |
| 3,947,278 | 3/1976 | Youtsey | 252/511 X |
| 4,107,092 | 8/1978 | Carnahan et al. | 252/511 |

FOREIGN PATENT DOCUMENTS 989159 5/1976 Canada .

*Primary Examiner*—Benjamin R. Padgett
*Assistant Examiner*—J. L. Barr
*Attorney, Agent, or Firm*—Wigman & Cohen

[57] ABSTRACT

An electrically conductive composition and method for making same is disclosed. The composition includes a uniform mixture of electrically conductive particles comprising pyrolytic carbon doped or coated with a component taken from Group III–VIII elements of the Periodic Table and a curable, non-conducting polymer binder.

19 Claims, No Drawings

ELECTRICALLY CONDUCTIVE LAYER AND METHOD FOR ITS PRODUCTION

BACKGROUND OF THE INVENTION

The invention relates to an electrically conductive layer comprising a uniform mixture of an electrical conductive component in the form of minute particles in an electrically nonconductive, curable polymer, and a method for the production of same.

The electrically conductive layer of the invention can be used to produce electrical resistors. In addition, the electrically conductive layer of the present invention may also be employed for screening or shielding purposes, for example, for grounding containers and the like.

Especially when used as an electrical resistor, there is a requirement that the temperature coefficient of the layer be both as small as possible and as constant as possible over a wide temperature range. The temperature coefficient is generally determined by dividing the change in the resistance value (based on the value at room temperature) by the resistance value at room temperature and the temperature difference. The temperature coefficient is especially important with resistance values having small tolerances. Therefore, a small and constant temperature is an especially important requirement for precision resistors.

In so-called organic thick layer technology, it is already known to produce layers for electrical resistors, whereby electrically conductive particles, such as soot, graphite, carbon fibers, silver, nickel, chromium or even metal alloys or metal oxides are imbedded in an organic, electrically insulating and simultaneously bonding polymer, such as, polyethylene or epoxy or phenolic resin. After curing, an electrical conductive matrix is formed, whereby the electrical conductivity of the layer is determined by, among other things, the fill concentration, the arrangement and electrical characteristics of the particles admixed in the polymer.

The temperature coefficient in a layer to which carbon particles are added is dependent on the temperature. The temperature coefficient of metal or metal oxide layers can also be influenced by the composition of the layer, whereby it is independent of the resistance value. In carbon layer resistors the attainable electrical conductivity is limited to low ohm values by the relatively poor conductivity of the admixed particles of graphite, soot, or carbon fibers, and the carbon layer resistors have a high negative temperature coefficient.

Especially when non-precious (and therefore affordable) metals are used for admixture, the electrical long-term stability often becomes questionable because of redox processes at the surface. One generally obtains resistors having a positive temperature coefficient.

In inorganic thick layer technology it is also known to produce so-called cermet resistors. Here, low-melting types of glass are employed as non-conductive and simultaneously bonding components. High quality, oxidation resistant metals, such as silver, platinum, ruthenium, palladium, etc, or their oxides are preferably used as the electrical conductive matrix. By mixing several pastes having differing electrical conductivities, one can alter the specific resistance and the temperature coefficient, whereby the conductivity of the resulting paste is dependent on the specific conductivity of the precious metal admixed with the glass frit and the mixture ratio thereof.

When soot or graphite is used as conductive particles in an electrically insulating polymer, there are several disadvantages. As previously mentioned, the conductivity of the layer is dependent on, among other things, the fill concentration of the particles, one must have on hand various masses with differing packing densities to obtain a broad spectrum of electrical resistance values. Differing packing densities (or concentrations), however, lead to varying rheological characteristics of the layer. In addition, the different packing densities cause different warping behavior during the curing of the layer. The varying surface tension from layer to layer, which results from the varying characteristics of the soot and the graphite, contributes to poor reproducibility of the resistance values from batch to batch, especially when a screening process is used in the production of the resistor layers.

To achieve different resistance values while the packing density (concentration) of the particles in the polymer remains constant, it is already known to form the particles representing the electrically conductive component as refractory, inorganic oxide materials, on whose outer surface is arranged a layer of a carbon-containing pyropolymer. The electrically conductive component comprises from 10–95% by weight based on the final composition of the mixture and the particle size is below 20 μm. But different conductivities of such particles can only be obtained by varying the thickness of the layer of the pyrolytic carbon surrounding the individual refractory particles. The low range of conductivity values, which is necessary for high ohm resistance arrangements, can be obtained by greatly reducing the carbon-containing pyropolymer layer to a few single strata. The thus-attained high resistance values, however, are associated with an increasing degeneration of the behavior of the temperature coefficient. The explanation for this appears to reside in the relatively weakly defined continuity of the grain boundaries of the carbon layers. As the thickness of the layer decreases these contact points increase in significance. Because the stray resistance of the contact points with the grain boundaries is extremely sensitive to temperature, this condition is macroscopically expressed in a rapidly impaired temperature coefficient of the resistor as the carbon layer thickness decreases. Therefore, thicker layers of material with higher specific resistance values but the same resistance per area have lower resistor temperature coefficients.

OBJECTS AND SUMMARY OF THE INVENTION

A principal object of the present invention is to provide an electrically conductive layer of the type heretofore mentioned and a method for its production, having various resistance values while the packing concentration of the electrical conductive component in the bonding means remains constant, and, wherein the smallest possible value of temperature coefficient is also guaranteed.

According to the present invention this objective is attained by providing an electrically conductive component which is a semi-conducting material obtained through pyrolysis of a carbon-containing compound, and doped and/or coated with one or more elements from the Group III–VIII elements of the Periodic Table. The doping and/or coating step is undertaken during simultaneous or subsequent pyrolysis of a suitable hydrocarbon and a chemical compound containing the doping element.

The semi-conducting material employed in the present invention can be obtained by pyrolysis of gaseous or liquid hydrocarbons, such as, aliphatic, aromatic, or heterocyclic hydrocarbons and/or mixtures thereof. Alternatively, the semi-conducting material can be obtained by pyrolysis of powdered, carbon-containing organic materials, such as, dextrose, glucose, starch or coal pitch. In either case, pyrolysis is undertaken at a temperature of from about 600° C. to 1600° C.

The semi-conducting material possesses an electric conductivity of about $10^{-8}$ to about 10° ($\Omega^{-1}cm^{-1}$). The doping and/or coating of the above-mentioned semi-conducting material is carried out in the gaseous phase using a compound of elements of Group III–VIII of the Periodic Table by means of thermal decomposition. Elements that can be used are boron, silicon, germanium or phosphorous or mixtures thereof. Additionally, metals such as aluminum, titanium, zirconium, vanadium, chromium, tungsten, iron, cobalt, nickel or molybdenum or mixtures thereof can also be used.

In addition to the electrically conductive component, materials having a large electric loss factor and a large dielectric constant can be added to the polymer. These materials are ground to minute particles prior to adding. Refractory materials which possess large electric loss factors and great relative dielectric constants, barium titanate, titanium oxide, silicon oxide, aluminum oxide, iron oxide, silicon carbide, iron carbide, iron silicide, chromium silicide or a mixture thereof, may be mentioned.

If the pyrolysis, which is undertaken in the temperature range of from about 600° C.–1600° C. is carried out in the presence of a refractory material, the carbon or coating element and/or compound thereof is deposited on said refractory material in the form of a covering. The resulting electrical conductivity of this type of carbon is caused by the pyrolysis temperature and the quantity ratio of the hydrocarbon to the doping substance. Because most elements of Group III–VIII of the Periodic Table are deposited in the form of a non-conductor, the resulting conductivity can be adjusted by means of these doping substances.

The low temperature coefficients, which are attainable with the employment of this type of materials, are probably caused by a number of factors. Group III–VIII elements of the Periodic Table promote the dehydrogenation or graphitizing process which occurs during the hydrocarbon pyrolysis. The influence of the "contact points" between the carbon grain boundaries is decreased by greater layer thicknesses.

Cross connections between neighboring carbon atom positions, which are formed by doping elements, cannot be eliminated. All of these factors contribute to a temperature stability of the resistor produced of these materials.

From the foregoing, it will be apparent that the electrically conductive material can contain a mixture of a various semi-conductive materials, each of which possessing a different conductivity.

In another aspect of the present invention, the semi-conducting material is tempered in a vacuum or in hydrogen or inert gas atmosphere at temperatures ranging from about 800° C–1600° C.

The curing of the resistor layers, which are filled with carbon doped with elements taken from Group III–VIII of the Periodic Table can be performed economically in a microwave field. The effectiveness of the heat generated by microwaves is increased by the presence of dielectric pigments or dielectric points in the carbon itself. Suitable dielectric pigments are aluminum oxide, titanium oxide, aluminum phosphate, silicon dioxide, silicon carbide, aluminum nitride, and the like.

The highly effective dielectric materials embodied in the polymer matrix develop heat very quickly in a microwave field. Each particle of material can be viewed as a heating element. When these particles are spread evenly through the polymer matrix, the result is a rapid and economical curing of the polymer bond.

The curing by means of microwaves is effective in the frequency range of from about 2400 to 6000 MHz, but is preferably undertaken at 2450 MHz.

The following examples are intended to more fully illustrate the present invention. However, these examples are not meant to be limiting.

EXAMPLE 1

100 g titanium oxide particles smaller than 5 μm and having a surface area of 15 $m^2/g$ were treated with a gas mixture consisting of 45% propane, 5% borontrichloride and 50% hydrogen at a temperature of 1000° C.

The thus produced electrically conductive material was finely ground in a ball mill and dispersed in a polymer binder in a pearl mill at a weight ratio of 55% conductive material to 45% epoxy binder to yield a screening paste.

The thus obtained screen printing paste printed onto a hard paper substrate by means of screen printing and cured in a microwave oven with a capacity of 40 $W/cm^2$ within 1.5 minutes.

The resulting resistor arrangement had a value of 840 KΩ/□ and a temperature coefficient of −200 ppm/°C.

EXAMPLE 2

100 g aluminum oxide smaller than 5 μm and having a surface area of 8 $m^2/g$ was treated with a gaseous mixture consisting of 30% acetylene, 3% titanium tetrachloride and 67% argon at a temperature of 900° C.

The thus obtained electrically conductive material was finely ground in the ball mill with 30 ml ethanol, and as with Example 1, printed onto a hard paper substrate by means of screen printing. The resulting arrangement was cured in an air oven at 180° C. for 30 minutes.

The resultant resistor has a value of 500 KΩ/□ and a temperature coefficient of −350 ppm/°C.

EXAMPLE 3

100 g of aluminum phosphate with a surface area of 17 $m^2/g$ and a particle size of less than 5 μm was treated with a gaseous mixture consisting of 80% nitrogen and 20% cyclohexane at a temperature of 800° C. for 25 minutes.

Then the temperature was increased to 900° and the treatment was continued with 5% silicon tetrachloride in hydrogen for a period of 5 minutes.

The resulting conductive material was worked into a screen printing paste, as described in Example 1, printed on hard paper and cured in a microwave oven with a capacity of 25 $W/cm^2$ within 2 minutes.

The resulting resistor arrangement had a value of 120 KΩ/□ and a temperature coefficient of −300 ppm/°C.

It should be understood that the present invention is not to be construed as being limited by the illustrated embodiments. It is possible to produce other embodiments without departing from the inventive concepts herein disclosed. Such embodiments are within the ability of one skilled in the art.

We claim:

1. Electrically conductive composition comprising 10 to 95% by weight of a uniform mixture of minute electrically conductive particles in an electrically non-conductive, curable polymer, said electrically conductive particles comprising a semi-conductive material formed by pyrolysis of a carbon-containing compound and doped and/or coated with Group III–VIII elements of the Periodic Table, said elements being taken from the group consisting essentially of boron, silicon, germanium, phosphorous, aluminum, titanium, zirconium, vanadium, chromium, tungsten, iron, cobalt, nickel, molybdenum, or mixtures thereof.

2. The electrically conductive composition according to claim 1, wherein the semi-conductive material is formed by pyrolysis of gaseous or liquid hydrocarbons, such as aliphatic, aromatic, or heterocyclic hydrocarbons and/or mixtures thereof.

3. The electrically conductive composition according to claim 1, wherein the semi-conductive material is formed by pyrolysis of powdered, carbon-containing, organic materials such as dextrose, glucose, starch or coal pitch.

4. The electrically conductive composition according to claim 1, wherein the doping and/or coating agents of the semi-conductive material are introduced from the gas phase of the compounds of the Group III–VIII elements of the Periodic Table by means of temperature action.

5. The electrically conductive composition according to claim 1, wherein the semi-conductive material has a conductivity of about $10^{-8}$ to $10^{\circ}$ ($\Omega^{-1}\cdot cm^{-1}$) at room temperature.

6. The electrically conductive composition according to claim 1, further including a predetermined amount of a material having a large electrical loss factor and a relatively large dielectrical constant in the form of finely ground particles admixed in the polymer.

7. The electrically conductive composition according to claim 1, wherein said doped and/or coated electrically conductive component is deposited in at least a single layer on the outer surface of finely ground particles of a refractory material having a large electrical loss factor and a great relative dielectric constant.

8. The electrically conductive composition according to claim 7, wherein said refractory material is taken from the group consisting of barium titanate, titanium oxide, silicon oxide, aluminum oxide, iron oxide, silicon carbide, iron carbide, iron silicide, chromium silicide or mixtures thereof.

9. The electrically conductive composition according to claim 1, wherein said electrically conductive component is a mixture of semi-conductive materials, of which each possesses a different conductivity.

10. An electrically conductive article comprising from about 10 to about 95% by weight inorganic oxide refractory particles coated with pyrolytic carbon, said pyrolytic carbon further including an electrically conductive component taken from Group III–VIII of the Periodic Table, said coated refractory particles being bound together and dispersed within a polymeric matrix to form a coating material, and a substrate upon which said coating material is secured.

11. The article according to claim 10 in the form of a resistor wherein said substrate is hard paper.

12. The article according to claim 10, wherein said electrically conductive component includes mixture of semi-conductive material, each having a different conductivity than the other.

13. A method for making an electrically conductive composition comprising the steps of:

forming a semi-conducting material by pyrolysing a carbon-containing material;

applying a doping or coating agent to said semi-conductive material, said doping or coating agent being taken from the group consisting of boron, silicon, germanium, phosphorous, aluminum, titanium, zirconium, vanadium, chromium, tungsten, iron, cobalt, nickel, molybdenum or mixtures thereof;

admixing said doped or coated semi-conductive material in a curable, non-conducting polymer binder.

14. The method according to claim 13, wherein the pyrolysis of the carbon-containing material is undertaken at a temperature of about 600° C.–1600° C.

15. The method according to claim 13 further including the step of tempering the semi-conducting material in a vacuum, in a nitrogen or an inert gas atmosphere at temperatures between 800° and 1600° C.

16. The method according to claim 13 further including the step of curing the electrically conductive composition by microwaves.

17. The method according to claim 16, wherein the curing step is accomplished with microwaves in the frequency range of between 2400 to 6000 MHz.

18. The method according to claim 16 further including the step of coating inorganic oxides with said doped or coated semi-conductive material prior to curing said polymer.

19. The method according to claim 16, wherein the curing step is accomplished with microwaves at a frequency of 2450 MHz.

* * * * *